US005747974A

United States Patent [19]

Jeon

[11] Patent Number: 5,747,974

[45] Date of Patent: May 5, 1998

[54] INTERNAL SUPPLY VOLTAGE GENERATING CIRCUIT FOR SEMICONDUCTOR MEMORY DEVICE

[75] Inventor: Jun-Young Jeon, Seoul, Rep. of Korea

[73] Assignee: Samsung Electronics Co., Ltd., Suwon, Rep. of Korea

[21] Appl. No.: 664,952

[22] Filed: Jun. 12, 1996

[30] Foreign Application Priority Data

Jun. 12, 1995 [KR] Rep. of Korea ..... 15394/1995

[51] Int. Cl.[6] ..... G05F 1/59

[52] U.S. Cl. ..... 323/269; 323/274; 323/281

[58] Field of Search ..... 323/268, 269, 323/273, 274, 281

[56] References Cited

U.S. PATENT DOCUMENTS

| | | | |
|---|---|---|---|
| 4,502,152 | 2/1985 | Sinclair | 323/268 |
| 5,010,292 | 4/1991 | Lyle | 323/274 |
| 5,034,676 | 7/1991 | Kinzalow | 323/268 |
| 5,083,078 | 1/1992 | Kubler et al. | 323/268 |
| 5,258,653 | 11/1993 | Perry | 323/269 |
| 5,258,701 | 11/1993 | Pizzi et al. | 323/273 |
| 5,525,895 | 6/1996 | Fishman | 323/269 |
| 5,587,648 | 12/1996 | Jinbo et al. | 323/274 |

OTHER PUBLICATIONS

"A 45-ns 16-Mbit DRAM with Triple-Well Structure" IEEE Journal of Solid-State Circuits, vol. 24, No. 5 Oct. 1989, pp. 1170-1174.

*Primary Examiner*—Jeffrey L. Sterrett

*Attorney, Agent, or Firm*—Marger, Johnson, McCollom & Stolowitz, P.C.

[57] ABSTRACT

Internal supply voltage generating circuits generate internal supply voltages at voltage levels below an external supply voltage. The internal supply voltages operate peripheral circuits and array circuits. A reference voltage generates a constant reference voltage. First and second dividing circuits output a given voltage in response to the internal supply voltage. First and second differential amplifiers compare the reference voltage with each of the output voltages from the first and second dividing circuits. First and second driving circuits supply the internal supply voltage from the external supply voltage. First and second voltage boosting circuits clamp output voltage levels for the first and second driving circuits from the external supply voltage and raise the clamped output voltage level of the first driving circuit higher than the clamped output voltage level of the second driving circuit. The boosting circuits maintain a voltage offset between the first and second internal voltage supplies when the external supply voltage is increased above a normal operating range.

10 Claims, 5 Drawing Sheets

INTERNAL SUPPLY VOLTAGE GENERATING CIRCUIT FOR SEMICONDUCTOR MEMORY DEVICE

BACKGROUND OF THE INVENTION

1. Field of the Invention

The present invention relates to a circuit for converting an external supply voltage into an internal supply voltage and more particularly to an internal supply voltage circuit used in a semiconductor memory device. The present application is based upon Korean Application No. 15394/1995, which is incorporated herein by reference.

2. Description of the Related Art

The size of transistors in high density semiconductor devices are reduced to decrease the necessary drive current. To compensate for weak drive current, the transistor is made with a thin gate oxide layer. A thinner gate oxide layer decreases transistor reliability. To maintain high reliability, an internal supply voltage circuit generates an internal supply voltage Vint which has a reduced voltage level compared to an external supply voltage Vext supplied to the chip.

The internal supply voltage circuit generates a first supply voltage Varray that supplies voltage to an internal memory array pre-sense amplifier which amplifies data in a memory cell. A peripheral supply voltage circuit generates a peripheral voltage Vperi that supplies voltage to internal peripheral circuits. To reduce the required operating current and to improve equalizing characteristics of bit lines used in the memory array, the internal supply voltage Varray is generally set to be lower voltage level than the peripheral supply voltage Vperi.

FIG. 1 is a prior art circuit diagram illustrating a sensing circuit and a sensing control circuit for sensing data in a memory cell. Known art relating to such a data sensing circuit is disclosed in Korean patent application No. 91-13279 filed by the same assignee as the present invention and in IEEE Journal of Solid State Circuits vol. 24, p.1173, entitled "A 45 ns 16 Mbit DRAM with Triple Well Structure".

The circuit shown in FIG. 1 includes a memory cell 1, a pair of bit lines 2 and 3 having a folded bit line structure, an equalizing circuit 10 for equalizing the bit line pair 2 and 3 and a precharging circuit 4 for precharging the bit line pair 2 and 3. The circuit also includes an equalization activating signal generator 5 which controls the operation of the equalizing circuit 10, an NMOS sense amplifier 6, an NMOS sense amplifier control circuit 8 for selectively connecting a ground potential to the NMOS sense amplifier 6, a PMOS sense amplifier 7, and a PMOS sense amplifier control circuit 9 for selectively connecting a supply voltage to the PMOS sense amplifier 7.

The PMOS sense amplifier control circuit 9 includes a differential amplifier **9-*a* which maintains supply voltage level supplied to the PMOS sense amplifier 7 at the same value as the memory array internal supply voltage Varray. A drive transistor 9-*b* generates the memory array internal supply voltage Varray at a node LA. A level shifter 9-*c* controls a gate node LAPG on the drive transistor 9-*b***.

FIG. 2 includes timing diagrams illustrating the circuit operation of the construction in FIG. 1. Referring to FIGS. 1 and 2, before the word line is selected, an equalizing signal EQE is supplied as a logic "high" level signal by the equalization activating signal generator 5 and precharges to a bit line equalizing level VBL (which is equal to Varray/2).

The equalizing signal EQE is at a logic "low" level just before the word line WL is selected, which floats the bit line pair. When the word line WL connected to the transistor gate of the memory cell 1 is selected, the charge stored in the capacitor of the memory cell 1 is transmitted to the bit line 2. The discharge of the capacitor creates a charge sharing phenomenon where a minute voltage difference appears between the bit line pair 2 and 3.

The NMOS sense amplifier 6 is activated by generating a logic "high" level from a sense amplifier activating signal NSAE in the NMOS sense amplifier control circuit 8. In the bit lines 2 and 3, the bit line with the lowest potential is changed to a ground potential level. When a sense amplification activating signal PSAE in the PMOS sense amplifier control circuit 9 is driven to a logic "high" level signal, the differential amplifier **9-*a* supplies the supply voltage Varray to the node LA. In the bit lines 2 and 3**, the bit line with the highest voltage potential is driven to the memory array internal supply voltage level Varray.

To improve the equalizing characteristic of the bit line pair, the internal supply voltage level Varray is generated at a lower voltage level than the peripheral internal supply voltage level Vperi. FIG. 2 compares the line equalization time periods ta and tb. In the case where the voltage Varray level is lower than the voltage Vperi level, the word line is at a non-activated state and the equalizing signal EQE is supplied a logic "high" state having the voltage level Vperi. The time period is reduced for equalizing the bit line pair 2 and 3 from previously driven ground potential Vss and the voltage Varray.

When the EQE signal is driven at the voltage level Vperi, compared to being driven at the voltage level Varray, the equalization time is reduced because the transistors in the precharging circuit 4 and the equalizing circuit 10 operate in a saturation region (Vgs>Vds−Vt, wherein Vt is a threshold voltage). The amount of operating current is determined by multiplying a parasitic capacitance of the bit line by a voltage on the bit line. Thus, driving the supply voltage Varray at a lower level than internal supply voltage Vperi also reduces the amount of necessary operating current.

Typical operating voltages for the internal supply voltage circuitry is identified in the chip specification for a particular memory device. During a burn-in test, an external supply voltage is driven 10 percent higher than the typical operating voltage for the chip. During the high voltage condition, the internal supply voltage is no longer clamped to a given voltage level but is boosted along the external supply voltage.

An internal supply voltage boosting circuit includes at least one or more diodes connected in series between the external supply voltage and the internal supply voltage. When a voltage difference between the external supply voltage and the internal supply voltage is great enough to drive the diodes, the internal supply voltage is increased or "boosted" to a level matching the external supply voltage level. Thus, the high external voltage Vext during burn-in tests, boosts the voltages Varray and Vperi to the same value which matches the external supply voltage value. The time required to equalize the bit lines increases when the external voltage is at a high operating level.

FIG. 3 is a circuit diagram illustrating an internal supply voltage circuit in a prior art device. This detailed technology is disclosed in U.S. Pat. No. 5,144,585 issued to the same assignee as the present invention. The circuit in FIG. 3 shows an internal supply voltage circuit having a peripheral internal supply voltage Vperi generating circuit **11*a* and a memory array internal supply voltage Varray generating circuit 11*b***.

The internal supply voltage generating circuits 11*a* and 11*b* include first and second differential amplifiers 13*a* and 13*b*. The differential amplifiers 13*a* and 13*b* compare voltages Vperi_f and Varray_f output from voltage dividers 15*a* and 15*b* with a voltage Vref output from a reference voltage generator 12. A first and second driving circuit 14*a* and 14*b* are coupled to the outputs of the differential amplifiers 13*a* and 13*b* and drive the internal supply voltage levels. Voltage boosting circuits 16*a* and 16*b* are coupled between the external voltage line Vext and the internal voltage lines Vperi and Varray. The internal supply voltages are boosted to the same level as the external supply voltage during burn-in testing.

Referring to FIGS. 3 and FIG. 4, it is assumed that an input impedance of the first and second differential amplifiers 13*a* and 13*b* is infinite. The output voltages from the internal supply voltages are indicated by the following equations:

$$Vperi=Vref(1+R1/R2)$$

$$Varray=Vref(1+R1'/R2')$$

Therefore, the voltages levels Vperi and Varray can be adjusted by varying the resistance ratio of resistors R1, R2, R1' and R2'. As discussed above, to reduce the operating current of the memory device and to improve the response time for equalizing the bit lines, the voltage level Varray is driven lower than the voltage level Vperi. Thus, the value of R1'/R2' is set below the value of R1/R2.

If a voltage difference between the external voltage Vext and the internal supply voltages Vperi and Varray is not large enough to drive the first and second voltage boosting circuits 16*a* and 16*b*, the internal supply voltages have a clamped characteristic shown in FIG. 4. A voltage difference n•Vtp (wherein, "n" represents the number of diodes used in the voltage boosting circuit 16*a* or 16*b*, and "Vtp" represents a threshold voltage of a PMOS transistor) is capable of driving the first and second voltage boosting circuits 16*a* and 16*b* and according boosts the internal supply voltages.

When the external supply voltage Vext generates a voltage difference greater than func {n cdot Vtp}, the voltages Vperi and Varray have the output characteristics shown in FIG. 4. The voltage Varray is boosted to the voltage Vperi, as shown in interval A. The voltages Varray and Vperi have the same voltage level after passing through the interval A. The internal voltages Varray and Vperi are continuously boosted as the external supply voltage Vext continues to increase. The internal voltage Vperi and Varray are boosted to the same value because the same number of diodes are used in the first and second voltage boosting circuits 16*a* and 16*b*. Because there is not voltage offset between Vperi and Varray after interval A, the equalizing response time of the device increases and the internal drive current increases.

SUMMARY OF THE INVENTION

Accordingly, it is an object of the present invention to provide a semiconductor memory device having an internal supply voltage generating circuit with improved clamp characteristics.

It is another object of the present invention to provide an internal supply voltage circuit with improved equalizing characteristic for bit lines.

It is yet another object of the present invention to provide an internal supply voltage circuit that maintains a voltage offset between internal voltage levels with respect to changes in an external supply voltage.

To accomplish these and other objects, the present invention comprises an internal supply voltage circuit that generates an internal supply voltage less than an external supply voltage. The internal supply voltage circuit generates different voltage levels for peripheral circuitry and array circuitry. The invention includes a reference voltage generating circuit for generating a constant reference voltage. A first and second voltage divider circuit output voltages in response to the internal supply voltages. A first and second differential amplifier compare the reference voltage with the output voltages from the first and second dividing circuits. A first and second driving circuits supply the internal supply voltage from the external supply voltage.

Of particular interest is a first and second voltage boosting circuit which clamp the output voltage levels of the internal supply voltages. The boosting circuits generate a clamped output voltage level for the first driving circuit that is higher than the clamped output voltage level for the second driving circuit. The first voltage boosting circuit is connected between the output terminal of the first driving circuit and the external supply voltage terminal. The second voltage boosting circuit is connected between the output terminal of the second driving circuit and the external supply voltage terminal.

DETAILED DESCRIPTION OF THE PREFERRED EMBODIMENT

The term "burn-in test" is used in the present invention to represent a test method where weak transistors are broken or otherwise identified by applying a high voltage to the gates of memory cell transistors. Burn-in tests are used to identify defective chips after completion of initial fabrication. The burn-in test generally comprises operating the chip with an external voltage of 7–9 volts when the chip operating voltage is normally 5 volts.

Figure 3:
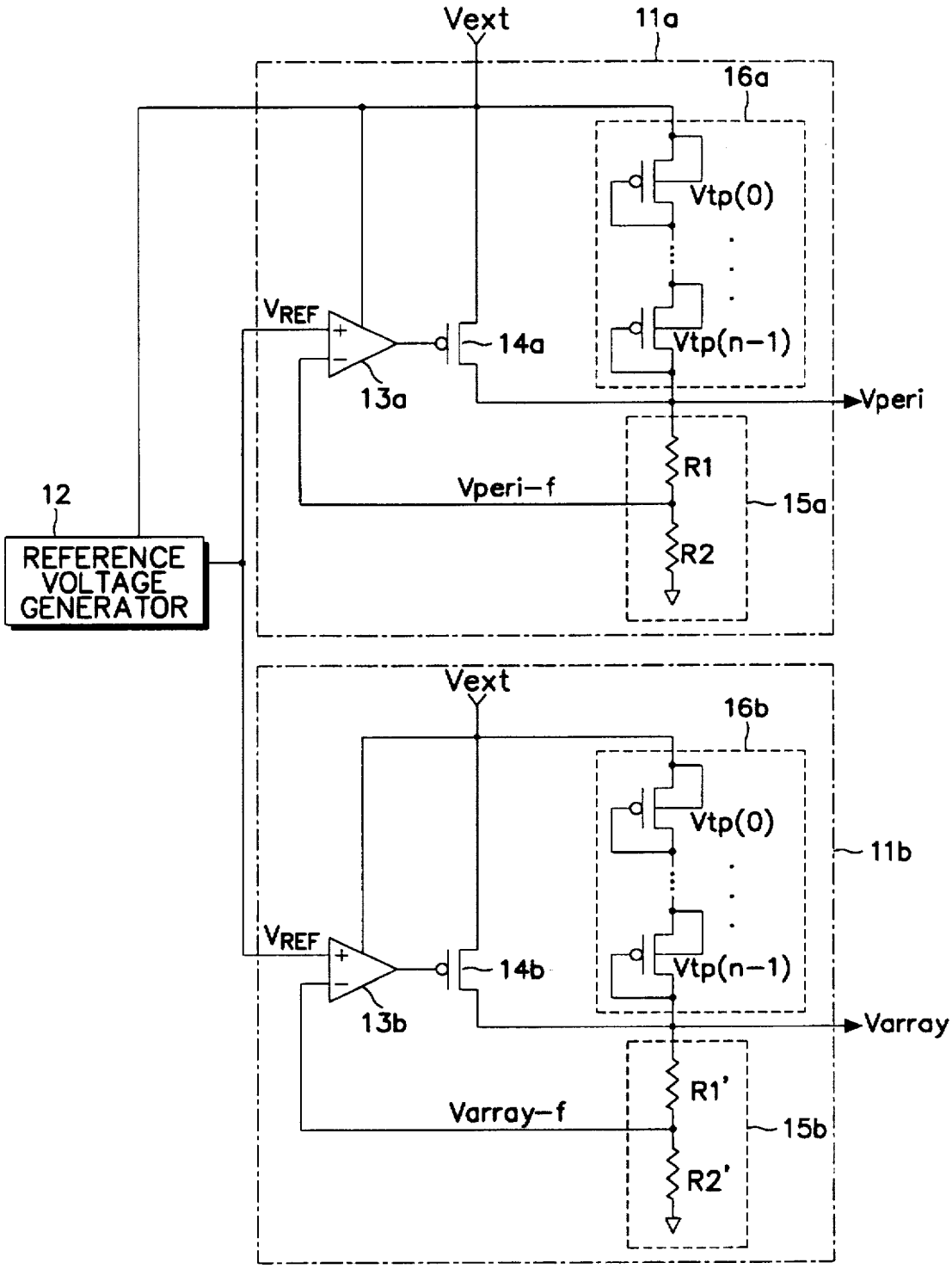
(PRIOR ART) Fig. 3
FIG. 3 is a circuit diagram illustrating a prior art internal supply voltage circuit.
Figure 6:
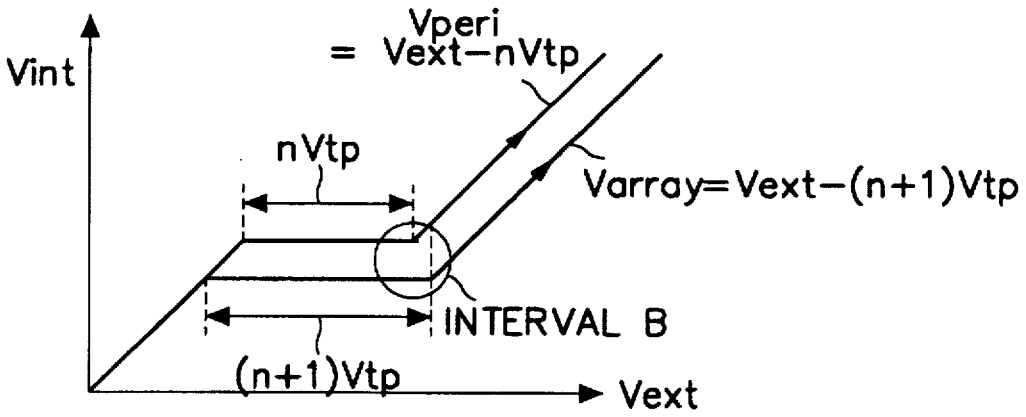
FIG. 6 is a graph illustrating an output characteristic for the circuit shown in FIG. 5.
Figure 5:
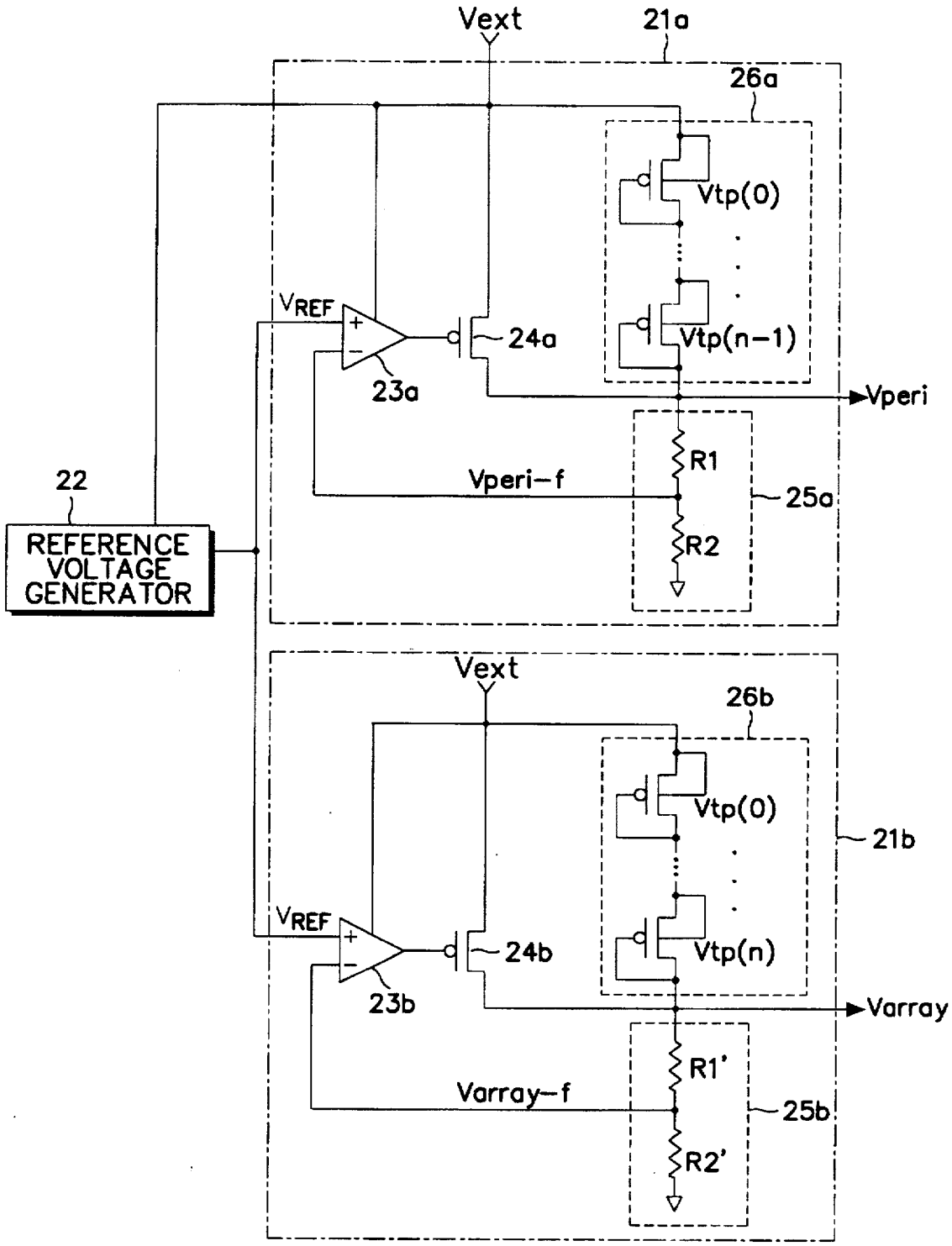
FIG. 5 is a circuit diagram illustrating an internal supply voltage circuit according to the present invention.

FIG. 5 is a circuit diagram for an internal supply voltage circuit according to the present invention. When compared with the construction of FIG. 3, the circuit shown in FIG. 5 has a different number of diodes in the voltage boosting circuits 26*a* and 26*b*. FIG. 6 is a graph illustrating an output characteristic for the circuit shown in FIG. 5. Referring to FIGS. 5 and 6, the voltage boosting circuit 26*b* has one more diode than the voltage boosting circuit 26*a*. In the preferred embodiment of the present invention, it is assumed that the number of diodes for the voltage boosting circuit 26*a* is "n", and the number of diodes of the voltage boosting circuit 26*b* is "n+1".

When the external supply voltage is boosted, the internal supply voltage is clamped during a given interval. When the voltage difference between the external supply voltage and the internal supply voltage is large enough, the internal supply voltages are gradually raised proportionally with increases in the external supply voltage, as shown in interval B of FIG. 6. Under the above state, the voltages Vperi and Varray are represented by the following equations:

$$Vperi=Vext-n(Vtp)$$

$$Varray=Vext-(n+1)Vtp$$

Figure 4:
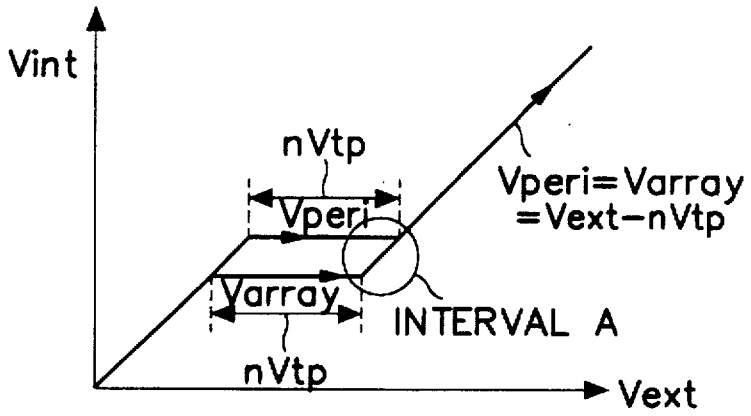
(PRIOR ART) Fig. 4
FIG. 4 is a graph illustrating an output characteristic for the circuit shown in FIG. 3.

As shown in the above equations, the voltages Vperi and Varray are not driven to the same voltage level as was previously shown in interval A of FIG. 4. To prevent the increased bit line equalizing time period that would result from the Varray and Vperi levels being driven to same voltage level, at least one or more additional transistors are connected in the voltage boosting circuit 26b. A voltage difference between the voltages Vperi and Varray corresponds to the threshold voltage of the additional diode in circuit 26b and raises proportionally with the external supply voltage Vext.

Figure 1:
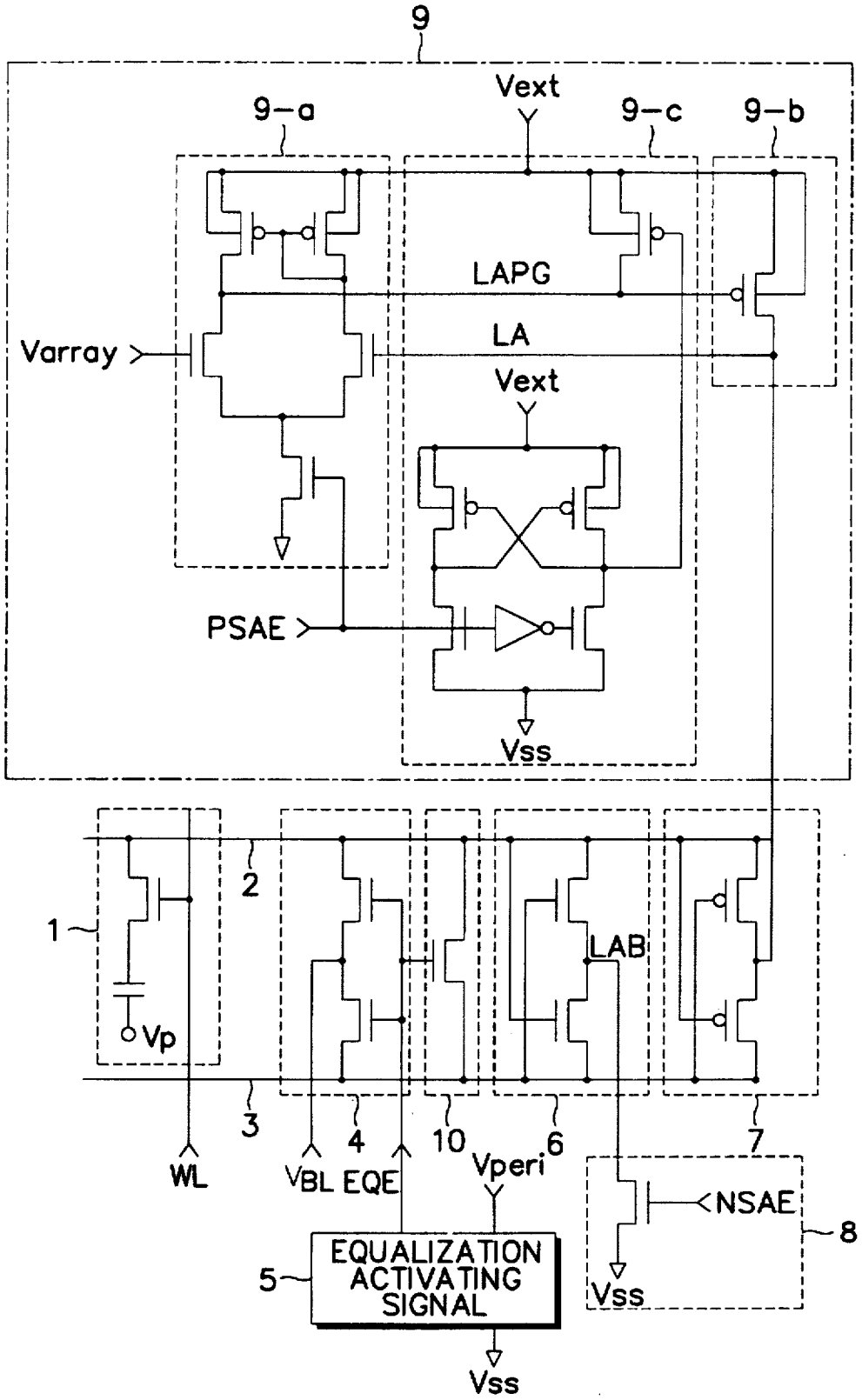
(PRIOR ART) Fig. 1
FIG. 1 is a prior art circuit diagram illustrating a sensing circuit and a sensing control circuit for sensing data in a memory cell.
Figure 2:
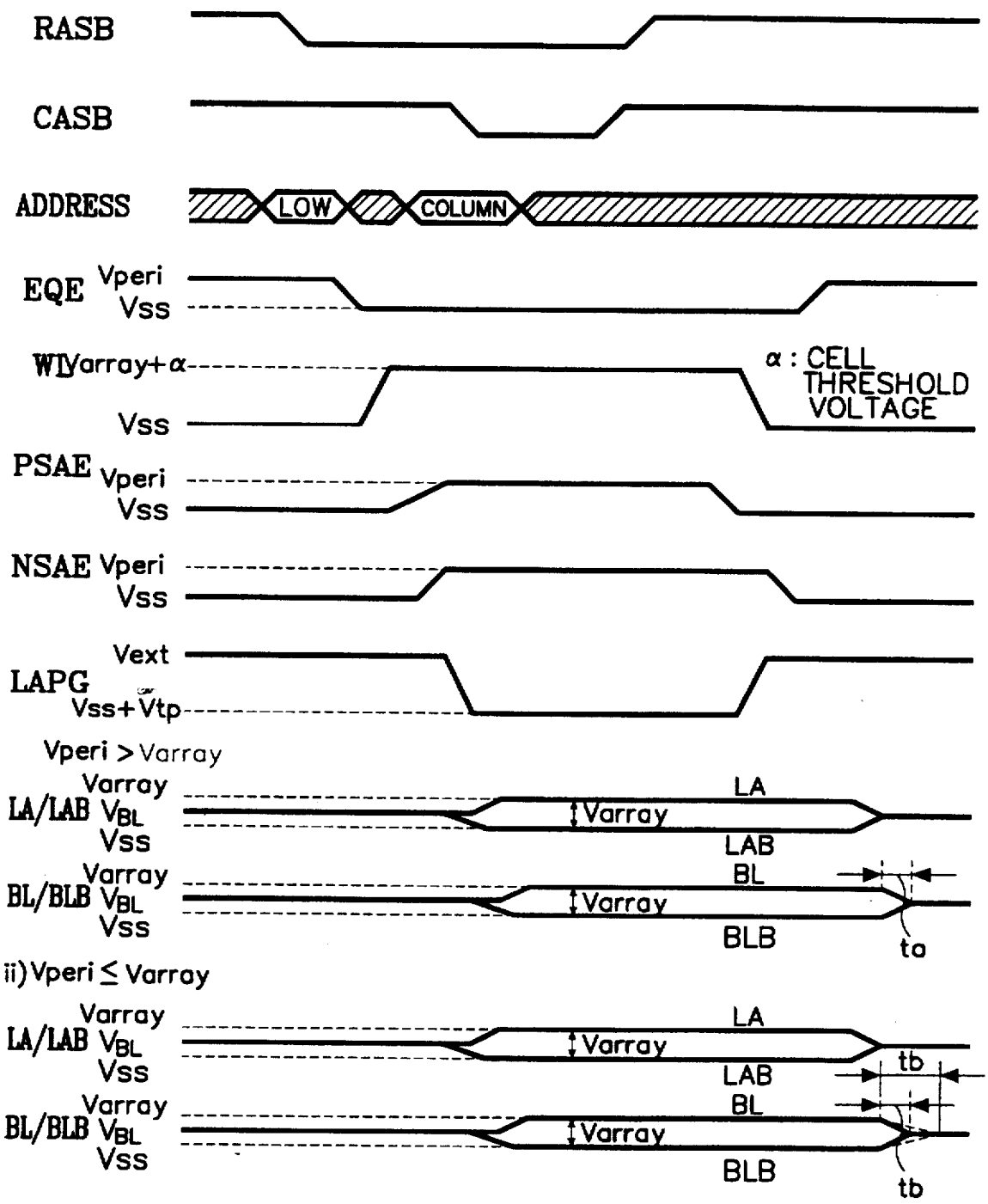
(PRIOR ART) Fig. 2
FIG. 2 shows timing diagrams for the operation of the circuit in FIG. 1.

The voltage level Varray is always lower than the voltage level of Vperi. Thus, the equalizing time for the bit lines 2 and 3 in FIG. 1 remains the same even when the external supply voltage Vext is in the over-voltage "burn-in" state shown in interval B. Thus, the improved equalizing time is maintained regardless of whether the external voltage Vext is intentionally increased for conducting a burn-in test or when the external voltage increases during normal operating conditions.

The voltage boosting circuits shown in FIG. 5 are a preferred embodiment of the present invention. However, the boosting circuits may use other circuit construction, such as NMOS transistors and still come within the scope of the invention.

In another preferred embodiment of the present invention, the two voltage boosting circuits have the same number of diode-connected transistors. However, the external supply voltage Vext is applied as a common back bias voltage to the transistors within the voltage boosting circuit controlling the voltage Varray. As a result, the voltage boosting circuit has the same effect as the circuit shown in FIG. 5. Since the external supply voltage Vext is applied as a back bias voltage to a bulk layer forming each transistor, the voltage Varray maintains a lower voltage level than Vperi. The lower voltage level for Varray in comparison to Vperi is also maintained when the external voltage Vext is increased beyond the normal chip operating voltage.

While the present invention has been described above with reference to the preferred embodiment, it will be appreciated by those skilled in the art that various substitutions and modifications can be made without departing from the spirit and scope of the invention as set forth in the following claims.

I claim:

1. A circuit for generating internal supply voltages from an external supply voltage, comprising:

a first internal voltage generating circuit having an input coupled to the external supply voltage and an output generating a first internal supply voltage, the first internal supply voltage clamped at a first clamping voltage for a given external supply voltage;

a second internal voltage generating circuit having an input coupled to the external supply voltage and an output generating a second internal supply voltage, the second internal supply voltage clamped at a second clamping voltage offset below the first clamping voltage for the external supply voltage,;

a first voltage boosting circuit coupled between the external supply voltage and the output of the first internal voltage generating circuit; and a second voltage boosting circuit coupled between the external supply voltage and the output of the second internal voltage generating circuit, the first and second voltage boosting circuit boosting the first and second internal supply voltage as the external supply voltage increases above the external supply voltage while maintaining the first and second internal supply voltage at the given offset voltage.

2. A circuit according to claim 1 including a reference voltage circuit coupled to the first and second internal voltage generating circuit and generating a reference voltage.

3. A circuit according to claim 2 wherein the first and second internal voltage generating circuit each include the following:

a voltage divider generating an output voltage in response to the internal supply voltage;

a differential amplifier comparing the reference voltage and the output voltage from the voltage divider; and a driving circuit coupled to the differential amplifier for generating the internal supply voltage from the external supply voltage.

4. The circuit according to claim 1 wherein the first and second voltage boosting circuits each comprise an array of diodes.

5. The circuit according to claim 1 wherein the first and second voltage boosting circuits each comprise an array of PMOS transistors.

6. The circuit according to claim 5 wherein the second voltage boosting circuit has at least one more PMOS transistor than said first voltage boosting circuit.

7. A circuit according to claim 5 wherein the first and second voltage boosting circuit have an equal number of PMOS transistors and the PMOS transistors in the first voltage boosting circuit has a given threshold voltage higher than a given threshold voltage for the PMOS transistors in the second voltage boosting circuit.

8. A circuit for converting an external supply voltage applied to a semiconductor memory device into an internal supply voltage, comprising:

a reference voltage circuit for generating a reference voltage; and a voltage supply circuit having a first unit converting the external supply voltage into a first internal supply voltage that operates peripheral circuits and a second unit converting the external supply voltage into a second internal supply voltage lower than the first internal supply voltage for operating array circuits, said voltage supply circuit comprising:

first and second voltage dividers each having outputs and a given voltage divider ratio corresponding with the first and second internal supply voltage;

first and second comparators having inputs for receiving the reference voltage and the outputs of the first and second voltage dividers and outputs;

first and second driving circuits including inputs coupled to the outputs of the first and second comparators and outputs, the first and second driving circuits driving the first and second internal supply voltages with the external supply voltage according to the outputs of said first and second comparators;

first and second internal supply voltage boosting circuits having voltage reduction elements coupled between the outputs for the first and second driving circuits and the external supply voltage, the voltage reduction elements maintaining a voltage offset between the first and second internal supply voltages for variances in the external supply voltage outside a normal operating range of the semiconductor memory device.

9. A circuit according to claim 8 further comprising:

means for scaling the first and second internal supply voltage by a predetermined ratio;

means for comparing the reference voltage with the first and second scaled internal supply voltage and generating compared outputs; and means for driving the first and second internal supply voltages with the external supply voltage according to the compared outputs.

10. A circuit according to claim 9 including:

means for clamping the first and second internal supply voltage when the external supply voltage is less than 6 volts and equally increasing the first and second internal supply voltage at the same rate when the external supply voltage is increased above 6 volts.

* * * * *

UNITED STATES PATENT AND TRADEMARK OFFICE

CERTIFICATE OF CORRECTION

PATENT NO. : 5,747,974
DATED : May 5, 1998
INVENTOR(S) : Jeon

It is certified that error appears in the above-identified patent and that said Letters Patent is hereby corrected as shown below:

Column 1,
Line 67, "VBL" should read -- $V_{BL}$ --.

Column 5,
Line 61, "external supply voltage;" should read -- external supply voltage interval; --.
Line 67, "supply voltage,;" should read -- supply voltage interval; --.

Column 6,
Line 10, "voltage while" should read -- voltage interval while --.

Signed and Sealed this

Tenth Day of September, 2002

*Attest:*

*Attesting Officer*

JAMES E. ROGAN
*Director of the United States Patent and Trademark Office*